US005388795A

United States Patent [19]

Struthers et al.

[11] Patent Number: 5,388,795

[45] Date of Patent: * Feb. 14, 1995

[54] DEPTH ADJUSTABLE BRACKET FOR WALL MOUNT SPEAKERS

[75] Inventors: Scott Struthers; William J. Kindel, both of San Clemente; Geoffrey L. Spencer, Laguna Niguel; F. Hendrik Huebscher, Mission Viejo; Ronald Maurer, El Cajon, all of Calif.

[73] Assignee: Dana Innovations, San Clemente, Calif.

[ * ] Notice: The portion of the term of this patent subsequent to May 10, 2011 has been disclaimed.

[21] Appl. No.: 224,287

[22] Filed: Apr. 7, 1994

Related U.S. Application Data

[63] Continuation of Ser. No. 67,343, May 25, 1993, Pat. No. 5,310,149.

[51] Int. Cl.[6] ..... A47F 5/08

[52] U.S. Cl. ..... 248/231.9; 248/27.1; 181/150; 381/205

[58] Field of Search ..... 248/27.1, 27.3, 343, 248/231.9; 181/141, 150; 381/205, 193

[56] References Cited

U.S. PATENT DOCUMENTS

| | | | |
|---|---|---|---|
| 2,522,859 | 9/1950 | Carbonneau | 179/115.5 |
| 2,604,285 | 7/1952 | Knoch | 248/27 |
| 2,744,584 | 5/1956 | Hellon | 181/150 |
| 3,180,595 | 4/1965 | Brunsting et al. | 248/27 |
| 3,327,984 | 6/1967 | Rennie | 248/343 |
| 3,369,784 | 2/1968 | Whitney | 248/27 |
| 3,664,615 | 5/1972 | Kruger | 248/27 |
| 3,666,040 | 5/1972 | Junk | 181/150 |
| 3,727,004 | 4/1973 | Bose | 179/1 D |
| 3,871,606 | 3/1975 | Larson | 248/27.1 |
| 3,912,865 | 10/1975 | Seebinger | 179/1 E |
| 4,032,725 | 6/1977 | McGee | 381/205 |
| 4,133,975 | 1/1979 | Barker, III | 179/1 E |
| 4,179,009 | 12/1979 | Birkner | 181/150 X |
| 4,250,540 | 2/1981 | Kristofek | 362/368 |
| 4,266,092 | 5/1981 | Barker, III | 179/1 E |
| 4,439,643 | 3/1984 | Schweizer | 179/146 E |
| 4,444,369 | 4/1984 | Job | 248/27.1 |
| 4,546,850 | 10/1985 | Litner | 181/141 |
| 4,614,374 | 9/1986 | Lannert et al. | 292/337 |
| 4,673,149 | 6/1987 | Grote | 248/343 |
| 4,685,035 | 8/1987 | Nanjoh | 248/27.1 X |
| 4,688,596 | 8/1987 | Liebmann et al. | 137/360 |
| 4,727,587 | 2/1988 | Black | 381/188 |
| 4,760,510 | 7/1988 | Lahti | 362/365 |
| 4,778,134 | 10/1988 | Struthers et al. | 248/27.1 |
| 4,815,558 | 3/1989 | Krainhofer | 181/141 |
| 4,853,966 | 8/1989 | Skrzycki | 381/188 |
| 4,923,032 | 5/1990 | Nuernberger | 381/205 |
| 4,961,226 | 10/1990 | Saffran | 381/24 |
| 4,993,511 | 2/1991 | Hiraki | 381/205 X |
| 5,027,403 | 6/1991 | Short et al. | 381/24 |
| 5,082,083 | 1/1992 | Draffen | 181/150 |
| 5,088,574 | 2/1992 | Kertesz, III | 181/150 |
| 5,143,339 | 9/1992 | Ashcraft et al. | 248/343 |
| 5,205,755 | 4/1993 | Douty et al. | 439/247 |
| 5,206,464 | 4/1993 | Lamm | 181/150 |
| 5,221,069 | 6/1993 | Struthers et al. | 248/231.9 |
| 5,236,157 | 8/1993 | Reggiani | 248/27.1 |
| 5,292,092 | 3/1994 | Curtis et al. | 248/27.1 |
| 5,299,766 | 4/1994 | Curtis et al. | 248/27.1 |
| 5,310,149 | 5/1994 | Struthers et al. | 248/231.9 |

OTHER PUBLICATIONS

Boston Acoustics brochure for Designer Series In-Wall Loudspeaker Systems dated 1991.

*Primary Examiner*—J. Franklin Foss
*Attorney, Agent, or Firm*—Stetina Brunda & Buyan

[57] ABSTRACT

A bracket for the in-wall mounting of speakers having a bracket frame member configured to receive at least one speaker and also having a plurality of wing members attached to the bracket frame member. The wing members having a thin portion to facilitate attachment to a wall intermediate a wall frame and a wall covering such that bowling or bulging of the wall covering is mitigated and the need to notch or mortise the wall frame is eliminated. The wing members additionally comprise a thick portion which serves as a clamping member. The position of the wing members relative to the frame member is adjustable after the bracket has been installed into a wall without requiring removal of the bracket from the wall.

14 Claims, 4 Drawing Sheets

DEPTH ADJUSTABLE BRACKET FOR WALL MOUNT SPEAKERS

This application is a continuation of application Ser. No. 08/067,343, filed May 25, 1993, now U.S. Pat. No. 5,310,149.

FIELD OF THE INVENTION

The present invention relates generally to brackets for mounting components within frame and wallboard construction walls and ceilings. It relates more particularly to a depth adjustable bracket for the in-wall mounting of speakers and the like.

BACKGROUND OF THE INVENTION

The demand for high quality speakers has increased dramatically over the last twenty years. As a consequence, there is a large selection of high-quality speakers available on the market. Unfortunately, speakers are somewhat bulky and cumbersome. Thus, there has also been a demand to mount speakers in the ceiling and in walls.

The mounting of high quality speakers in the ceiling or in walls is an expensive enterprise, particularly since brackets to accommodate such mounting must typically be custom-made. Frequently, considerable effort is associated with the use of such brackets.

The effort required to mount in-wall speakers is of concern both in new construction and retrofit installations. In new construction installations a bracket is attached to the wall frame or studs of the wall prior to the application of a wall covering. In retrofit mounting installations a bracket is used to mount the speaker in a pre-existing wall, i.e., wherein the wall covering has already been applied. In such retrofit applications, an opening is typically formed within the wall covering and the bracket is then inserted through the opening and attached to the wall covering and/or studs disposed within the wall. As will be appreciated, both new installations and retrofit installation of in-wall speakers are difficult and time consuming processes.

Prior art brackets utilizing wings for attaching the bracket to the frame members are known. Such prior art brackets provide a substantial improvement over the use of custom brackets. One such prior art bracket is disclosed in U.S. Pat. No. 4,778,134, issued on Oct. 19, 1988, to Struthers et al., the contents of which are hereby incorporated by reference.

However, the use of prior art brackets which incorporate such wings requires that the frame members or studs to which the wings are attached be notched or mortised in order to accommodate the thickness of the wings such that the wallboard applied thereover does not bulge or bow outwardly due to the thickness of wings disposed intermediate the studs and the wall covering. It has been found that with wing members as thin as 1/16th inch (0.0625 inch) that sufficient bowing of the wall covering occurs to be objectionable.

As such, it would be desirable to provide a bracket for the in-wall mounting of speakers which does not require that the studs of the wall be mortised, i.e., which does not result in bowing of the wall covering.

Furthermore, prior art brackets typically suffer from the deficiency that they do not easily accommodate wall coverings of various thicknesses. Prior art brackets must typically be formed to accommodate a wall covering having a particular thickness, thus reducing the flexibility of the bracket for use in various different installations.

Those brackets which are adjustable to accommodate wall coverings of various thicknesses typically require that the bracket be removed from the wall in order to effect such adjustment. Thus, prior art brackets cannot be easily adjusted while disposed in place within the wall, i.e., in their installed configuration.

As such, it is also desirable to provide a wall mount speaker bracket that provides for quick and simple adjustment while installed within a wall so as to accommodate varying wall covering thicknesses.

Generally, prior art in-wall speaker mounting brackets are specifically intended for Use in either new construction installations or in retrofit installations. That is, a particular bracket is typically not suited for use in both types of installation. During new construction, the frame members or studs are exposed for easy attachment of the bracket thereto prior to the application of the wall covering thereover. Thus, easy access to the frame members or studs makes installation of the bracket a comparatively simple matter. However, in retrofit installations, the frame members or studs are covered with a wall covering which not only obscures the studs, but also severely limits access thereto. Thus, in such retrofit installations, it is much more difficult to attach the bracket to the studs.

Although contemporary practice has generally been to provide separate bracket configurations for use in new construction installations and retrofit installations, it would be desirable to provide a single bracket suitable for use in both.

SUMMARY OF THE INVENTION

The present invention specifically addresses and alleviates the above-mentioned deficiencies associated with the prior art. More particularly, the present invention comprises a depth adjustable bracket having flat mounting wings for the in-wall mounting of speakers and the like. The bracket has a bracket frame member in which a plurality of apertures are formed for receiving fasteners to attach at least one speaker, typically a plurality of speakers or a speaker assembly, thereto. The bracket also has a plurality of, preferably two, thin wing members adjustably attachable to the frame member for attaching the bracket frame member to the wall, i.e., to the studs of the wall frame. A position adjuster facilitates adjustment of the position of the wings relative to the bracket frame member.

The wing members comprise a thick portion disposed proximate an attachment means. The means of attachment provides a surface for attachment, typically via solvent bonding or sonic welding, of the wings to the moveable or adjustable parts of the bracket frame. The attachment means adjustably attaches the wing members to the bracket frame member. A thin portion of the wings extends outwardly from the thick portion. The thin portion is utilized to attach the bracket to wall frame members or studs during new installation and the thick portion alone is utilized in retrofit installations. The thin portion of the wing members may be cut or otherwise removed from the thick portion and the thick portion then utilized to clampably attach the bracket to the wall covering when used in retrofit installation. The thin portion is thus removable such that only the thick portion remains.

In new construction installations, i.e., when the wall frame members or studs of the wall have not yet been concealed by the wall covering, the bracket is installed simply by positioning the bracket such that the frame member thereof is disposed at a desired location and then fastening, via nails, screws, staples, etc., the wing members to adjacent studs over which the wing members are disposed. The thin portion thus provides for the attachment of the bracket to the wall frame and the thick portion acts as a clamping member capturing the later applied wall covering as discovered below.

By providing various lengths of wing members, their overlapping of adjacent studs can be assured regardless of construction type, i.e., standard (16 inch on center studs) or non-standard (24 inch on center studs), for example. The wing members are preferably attached to opposite sides of the frame member. However, those skilled in the art will recognize that the wing members may alternatively be attachable to adjacent sides of the frame members such that they are perpendicular in configuration. Additionally, those skilled in the art will recognize that more than two, i.e., three or four, etc., wing members may be utilized, each attached to one side of the frame member.

The thin portion of the wing member is preferably comprised of styrene and formed to be less than 0.040 inch in thickness, preferably approximately 0.20 inch in thickness. The utilization of wing members having such thin portions substantially eliminates bulging or bowing of the wall covering, i.e., drywall or sheet rock, the location where the wing members are disposed intermediate the wall covering and the studs. The thin portion of the wing member may be comprised high stressed material such as cavelar, carbon fiber, aluminum, etc. Those skilled in the art will recognize that various other materials are likewise suitable.

Corrugations formed in the thin portions of the wing member increase the structural strength thereof. Those portions of the corrugations disposed intermediate the wall covering and studs after installation are compressed into a flat configuration thereby.

Apertures may optionally be formed within the wing members, preferably the thin portions thereof, to facilitate attachment thereof to the studs of a wall. Such apertures provide both a visual indication of the position of a stud disposed beneath the wing member and facilitate the easy use of nails, screws or the like.

The thick portion of the wing members is preferably comprised of ABS, as is the bracket frame member, and is formed to be greater than 0.040 inch in thickness, preferable approximately 0.10 inch in thickness.

Alternatively, the entire wing members, both the thick and thin portions thereof, may optionally be formed to have a thickness between 0.050 inch and 0.075 inch, preferably approximately 0.060 inch.

The wing members are preferably formed by fabricating the thin portions and the thick portions thereof separately, and then attaching the two together. The thin portions are preferably formed by cutting them from 0.020 inch thick styrene and then vacuum forming, pressure forming and/or thermo-forming the corrugations therein. The thin portions are then attached to the thick portions via ultrasonic welding or adhesive bonding. Those skilled in the art will recognize that various other means for forming and/or attaching thin portions to the thick portions of the wing members are likewise suitable. Those skilled in the art will recognize that various other means for attaching the thin portions to the thick portions of the wing members are likewise suitable. For example, both the thick and thin portions of the wing members may alternatively be molded as an integral unit.

The bracket may optionally be provided with only the thick portions of the wings, particularly for use in retrofit installations.

The wing members are adjustably attached to the frame member such that the position of the bracket frame member relative to the wing members may be varied as desired. That is, the wing members may be attached to the bracket frame member so as to accommodate various wall covering thicknesses. Such adjustment is optionally accomplished by manually sliding the wing members to closer or further from the front edge of the frame member such that the distance between the wing members and the front edge of the frame member approximates the thickness of the wall covering. Positioning the front edge of the frame member flush with the wall covering provides optimal mounting of the speakers.

A detent post may optionally be attached to the bracket frame member such that detents formed upon the detent post engage complimentary detents formed upon the wing members to provide releasable locking engagement of the wing members to the frame member. However, those skilled in the art will recognize that various other detent means are likewise suitable.

Alternatively, adjustment screws may be provided to facilitate adjustable positioning of the wing members relative to the frame. The adjustment screws would be accessible from inside the frame such that adjustment may be effected by an installer after the wings have been attached to wall frame members. The adjustment screws preferably pass through portions of the wing members which are disposed inside the frame, then through the frame itself, and on into portions of the wing members disposed outside the frame, such that tightening the adjustment screws clamps the frame intermediate the inside and outside portions of the wing members. Thus, tightening the adjustment screws lock the wings into position relative to the bracket frame member. Slots are formed in the frame to facilitate movement of the wing members and adjustment screws relative thereto. Bosses extend from the outer portions of the wing members and have threads formed internally to receive the threaded portion of the adjustment screws.

Thus, to adjust the position of the frame relative to the wall covering, the installer merely loosens the adjustment screws and slides the bracket frame member in or out of the wall until its outermost edge is generally flush with the outer surface of the wall covering, and then tightens the adjustment screws.

Bendable metal tabs are optionally inserted into the bracket frame member and may be bent over so as to prevent the bracket frame member from falling into the wall during the installation process, particularly in retrofit installations wherein the thin portions of the wing members are not utilized. Each metal tab preferably has serrations or barbs formed upon the end thereof which is inserted into the frame. The serrations lock the bendable metal tabs into the frame such that they do not easily pull therefrom.

A wire protector, formed of cardboard, paperboard, or another insulating material may optionally be inserted into the frame so as to protect the wires of a speaker assembly installed therein from physical abuse during handling and from contamination, i.e., paint, plaster, etc. An aperture formed in the generally planer wire protector allows electrical conductors to pass therethrough.

These, as well as other, advantages of the present invention will be more apparent from the following description and drawings. It is understood that changes in the specific structure shown as described may be made within the scope of the claims without departing from the spirit of the invention.

BRIEF DESCRIPTION OF THE DRAWINGS

FIG. 1(*a*) is a perspective view of the depth adjustable bracket of FIG. 1 showing the wire protector inserted within the frame;

DETAILED DESCRIPTION OF THE PREFERRED EMBODIMENT

Figure 1:
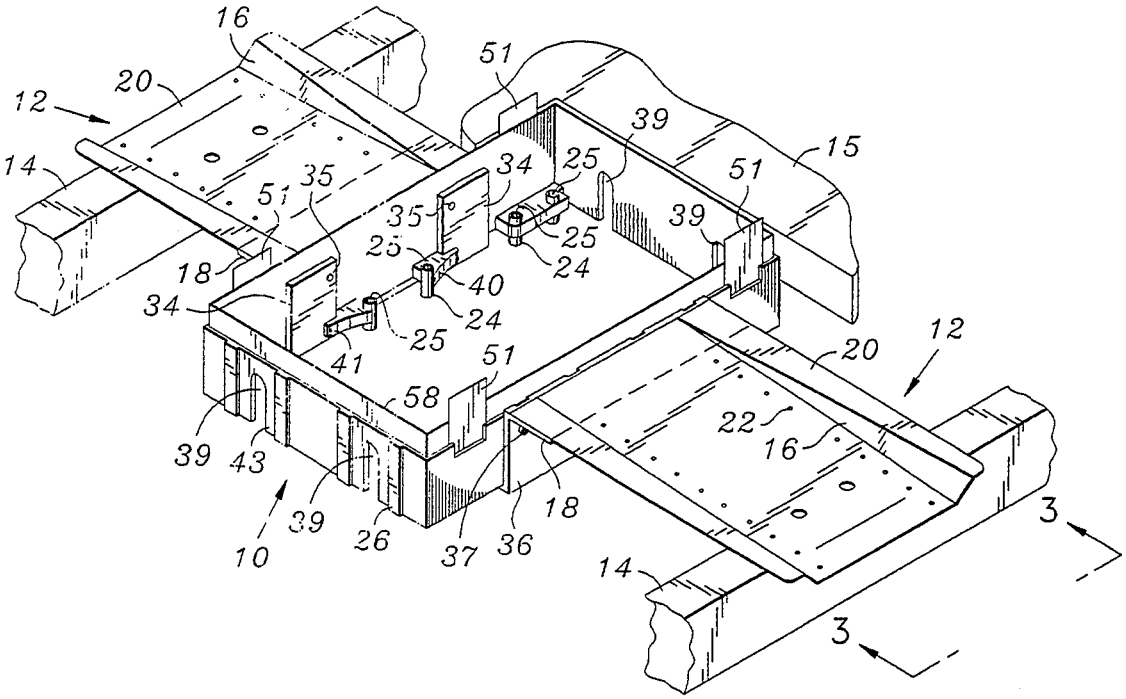
FIG. 1 is a perspective view of the depth adjustable bracket for wall mount speakers of the present invention.
Figure 1A:
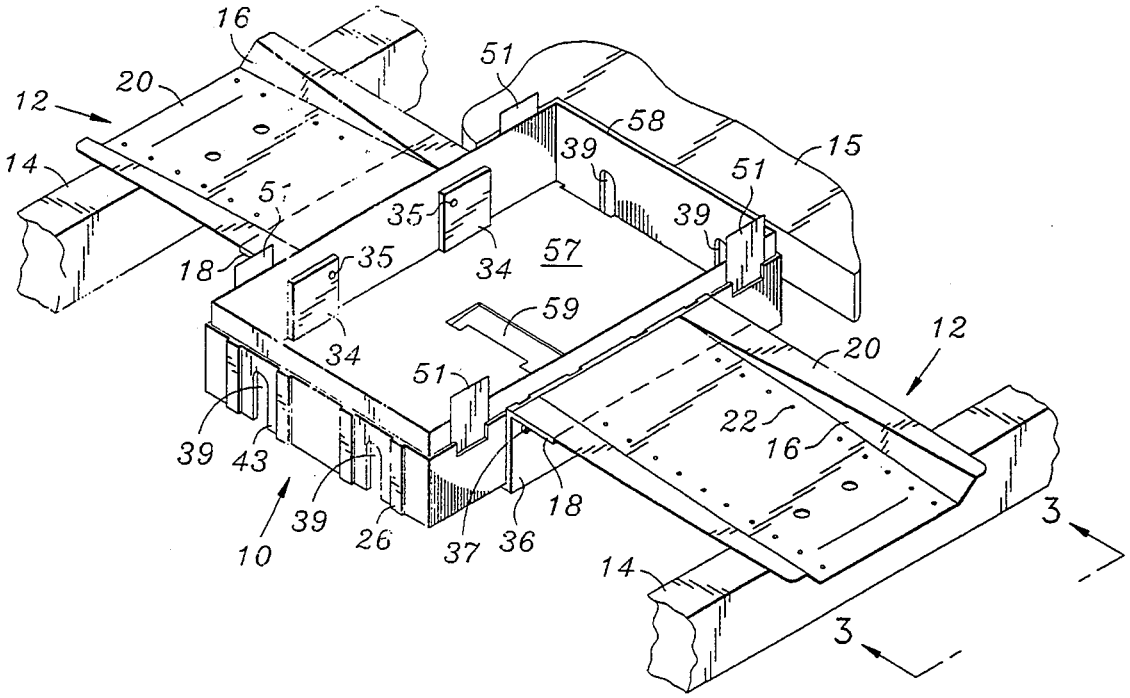
Figure 2:
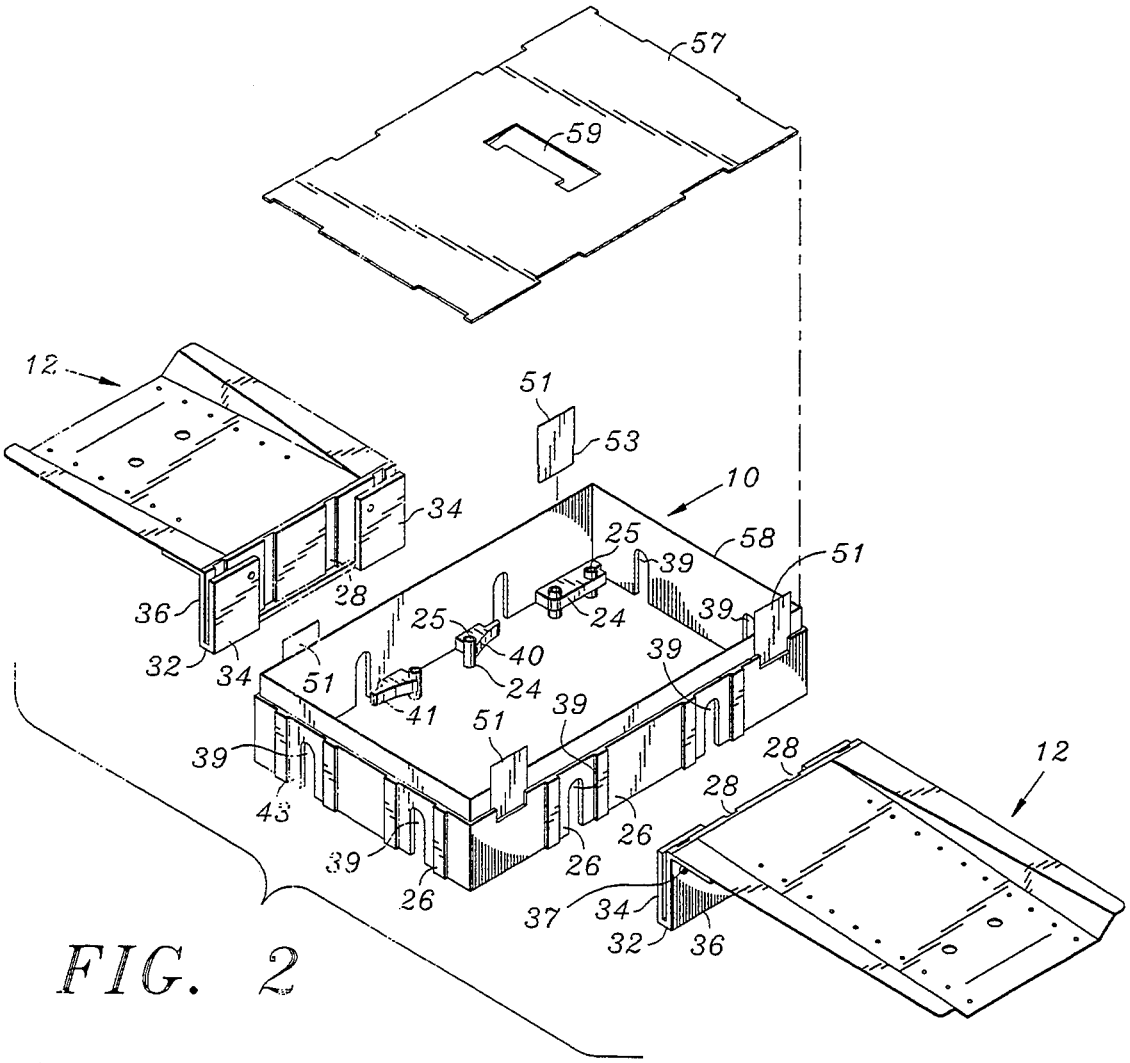
FIG. 2 is an exploded perspective view of the bracket of FIG. 1(*a*)
Figure 3:
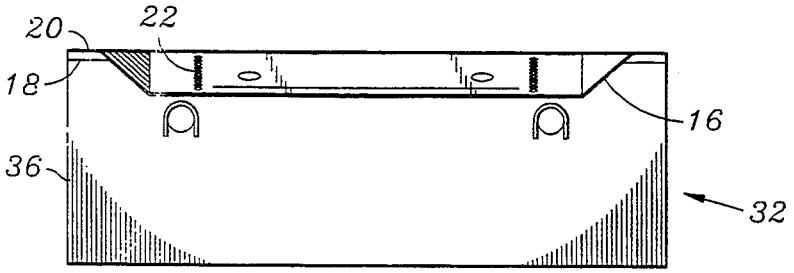
FIG. 3 is an end view of a wing of the bracket FIGS. 1, 1(*a*), and 2.
Figure 4:
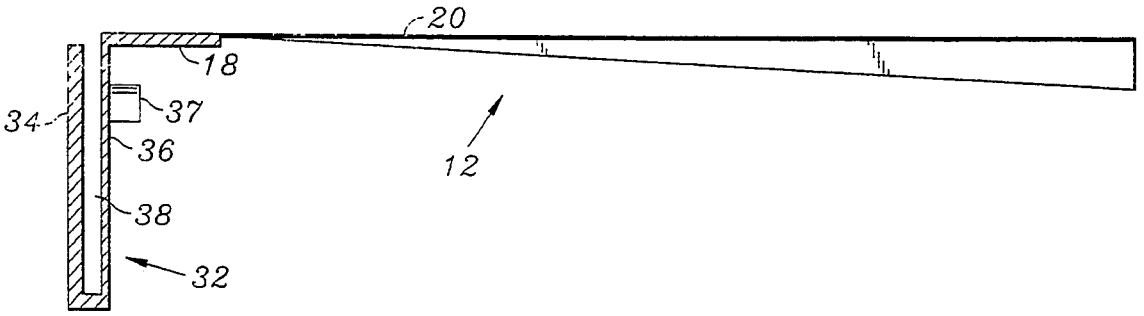
FIG. 4 is a side view of a wing of FIGS. 1, 1(*a*), and 2.

The detailed description set forth below in connection with the appended drawings is intended as a description of the presently preferred embodiment of the invention, and is not intended to represent the only form in which the present invention may be constructed or utilized. The description sets forth the functions and sequences of steps for constructing and operating the invention in connection with the illustrated embodiment. It is to be understood, however, that the same or equivalent functions and sequences may be accomplished by different embodiments that are also intended to be encompassed within the spirit and scope of the invention.

Although the present invention is described herein as being utilized for the mounting of speakers, such use is by way of example only and not by way of limitation. Those skilled in the art will recognize that the present invention may be utilized to mount various articles in walls and ceilings.

The depth-adjustable, thin winged bracket for wall mount speakers of the present invention is illustrated in FIGS. 1–8 of the drawings which depict a presently preferred embodiment of the invention. Referring now to FIGS. 1–4, the bracket is generally comprised of a bracket frame member 10, having a plurality, preferably two, of wing members 12 extending therefrom. The wing members 12 are preferably rectangular in shape and may optionally be of different lengths to accommodate desired positioning of the bracket frame member 10 intermediate two wall frame members or studs 14 during installation thereof.

In the preferred embodiment of the present invention, the bracket frame member 10 is configured as a rectangle. However, those skilled in the art will recognize that various other configurations, i.e., round, triangular, square, hexagonal, etc., are likewise suitable. The position of each wing member 12 relative to the bracket frame member 10 is adjustable such that the positioning of the bracket frame member 10 relative to the wall covering 15 through which it extends is variable to accommodate various thicknesses of the wall covering 15.

Each wing member 12 preferably comprises a thick portion 18 and a thin portion 20. The thick portion preferably extends a short distance, i.e., approximately 0.5 inch to 1.0 inch and the thin portion 20 preferably extends between four and twelve inches beyond or outboard of thick portions 18. Even longer wings may be utilized to affect attachment to non-standard wall constructions. The thin portions 20 are readily removable from the thick portions 18.

Alternatively, the entire wing members 12, both the thick 18 and thin 20 portions thereof, may optionally be formed to have a uniform thickness of between 0.050 inch and 0.075 inch, preferably approximately 0.060 inch.

The length of the thin portions 20 of the wings 12 is selected to accommodate the particular type of construction, i.e., 16 inch on center studs, 24 inch on center studs, etc., spacing of the studs 14 comprising the wall frame. Corrugations 16 are optionally formed in the thin portion of the wing members 12 to increase the rigidity or structural strength thereof.

Apertures 22 are optionally formed within each wing member to facilitate viewing of the studs 14 disposed there beneath and to facilitate use of fasteners during the installation process. By looking through the apertures 22, the installer can view the studs 14 disposed therebetween to aid in positioning of the bracket prior to attachment of the wing members 12 to the studs 14. The use of fasteners is facilitated since the user can observe the position of the studs 14 beneath the wings 12 and thus know precisely where to apply the fasteners.

Apertures 25 formed within frame member 24 facilitate attachment of the speaker or speakers thereto. Exterior. guides 26 formed upon the outer periphery of the bracket frame member 10 are received within complimentary grooves 28 formed upon the inside surface of outboard portions 36 only of the adjustable attachment means 32 of the wing members 12.

The inboard portions 34 of the wing members 12 optionally engage interior guides 40 and 41 formed upon the inner periphery of the bracket frame member 10. The exterior guides 26 and the interior guides 40 and 41 facilitate sliding movement of the wings 12 relative to the bracket frame member 10. That is, the exterior guides 26 slide within the grooves 28 and the interior guides 40 and 41 capture inboard portions 34 of wing members 12. Attachment of the wing members 12 to the bracket frame member 10 may optionally be accomplished without the use of any guides.

The wing members 12 adjustably attach to the bracket frame member 10 via a U-shaped flange defined by inner 34 and outer 36 flange members. Optional adjustment screws 35 pass through the inner flange members 34, the bracket frame member 10, and into threaded bosses 37 formed upon the outer surfaces of the outer flange members 36. The bosses need not be pre-threaded, when the adjustment screws 35 are first received within the bosses 37, threads are formed. Each screw passes through a slot 39 formed in the bracket frame member 10 such that the wing member 12 and the adjustment screw 35 is moveable relative to the bracket frame member 10 when the screw 35 is loosened and such that tightening of the screw 35 clamps the bracket frame member 10 intermediate the inner 34 and outer 36 flange members, thus rigidly attaching the wings 12 to the bracket frame member 10. The heads of the adjustment screws 35 are accessible to an installer after the bracket frame member 10 has been positioned within a wall, thus allowing adjustment after installation of the depth adjustable bracket of the present invention. Such adjustment is accomplished by visually aligning the outermost edge 58 of the bracket frame member 10 such that it is generally flush with the wall covering 15.

A cardboard, paperboard, or paper cut-out template may optionally be utilized to cut an opening in the wall board 15 of the desired size and shape.

A wire protector 57 having an aperture 59 formed therein may optionally be positioned within the bracket frame member 10 so as to protect the electrical conductors and/or speakers from mishandling, and/or contamination via paint, plaster, etc., during and subsequent to the installation process. The wire protector 57 is preferably comprised of cardboard, paperboard, or the like. Those skilled in the art will recognize that various other insulating materials are likewise suitable. The aperture 59 is preferably formed by cutting the cardboard or other material such that a foldable flap is formed and folding the flap opens the opening 59.

Thus, since the depth adjustable bracket of the present invention is easily adjusted in position during the installation process, it is not necessary to detach the bracket from the wall to effect adjustment, as in the prior art. That is, the depth adjustable bracket of the present invention may be adjusted in depth after the wing members 12 have been attached to frame members of the wall, without requiring detachment of the wing members 12 from the wall to affect such adjustment.

Bendable metal tabs 51 are optionally inserted into apertures formed in the bracket frame member 10 and preferably have barbs or serrations 53 formed thereon to assure secure attachment to the bracket frame member 10, once inserted. The bendable metal tabs 51 may be bent over to catch the outer surface of a wall covering during the retrofit installation process wherein the thin part of the wing members 20 are not utilized, so as to prevent the bracket frame member 10 from falling into the wall, during the installation process.

Figure 6:
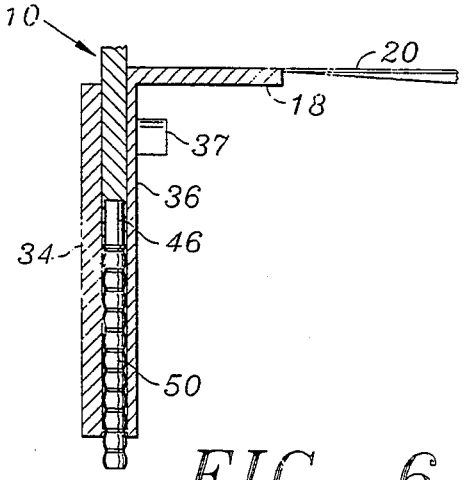
FIG. 6 is a cross-sectional side view of a portion of the frame member, wing member, and detent post.
Figure 5:
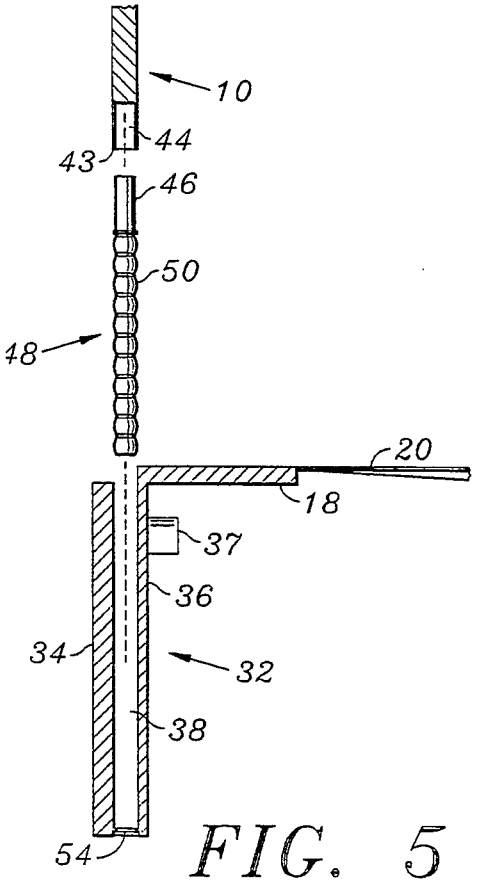
FIG. 5 is an exploded cross-sectional side view of a portion of the bracket frame member, wing member and detent post.

Referring now to FIGS. 5 and 6, an optional detent means for adjustable attaching the wing members 12 to the frame member 10 is illustrated. As before, the adjustable attachment means 32 comprises inner 34 and outer 36 flange members such that a groove 38 is formed therebetween.

A detent post 48 comprises a smooth portion 46 and a detent portion 50. A bore 44 formed within the rear surface 43 of the bracket frame member 10 receives the smooth portion 46 of the detent post 48. The detent post 48 is fixably inserted within the bore 44 such that it is not easily removed therefrom. Those skilled in the art will recognize that various means, i.e., adhesive bonding, ultrasonic welding, non-releasable or barbed detents, etc., are suitable for fixedly attaching the detent post 48 within the bore 44.

The smooth portion 46 of the detent post 48 and the bore 44 of the bracket frame member 10 are preferably circular in cross sections. Those skilled in the art will recognize that various complimentary cross sections are likewise suitable. The detent portion 50 of the detent post 48 has detents formed thereupon and is received within the groove 38 of the adjustable attachment means 32. the detents of the detent portion 50 engage a complimentary detent 54 formed within the groove 38 to releasably lock the wings 12 at a desired position relative to the frame member 10.

Figure 7:
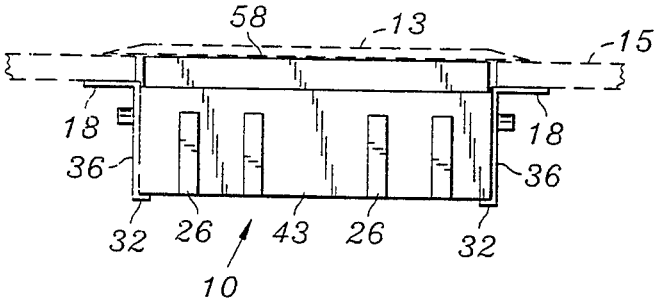
FIG. 7 is a top view illustrating use of the depth adjustable bracket in a prior construction or retrofit installation.

Thus, having thus described the structure of the depth adjustable bracket for wall mount speakers of the present invention, a brief discussion of its use may be beneficial. Referring now to FIG. 7, when using the present invention in retrofit installation, the thin portions 20 of the wing members 12 are removed therefrom, leaving the thick portions 18 attached to the adjustable means 32. This may be accomplished by tearing or by cutting, i.e., by utilizing shears, scissors, a knife, etc. Alternatively, the adjustable bracket for wall mount speakers may be provided without thin portions for use in retrofit applications.

An opening, corresponding generally in size and shape to the bracket frame member 10, such that the bracket frame member 10 may be received thereby, is formed within the wall covering 15 at the location where installation of a speaker is desired. The attachment means are adjusted such that the front edge 58 of the frame member 10 is approximately flush with the outer surface of the wall covering 15 when the thick portions 18 of the wings 12 are flush with the inner surface of the wall covering 15. This may be accomplished by either measuring the thickness of the wall covering 15 or through trial and error.

Use of the optional adjustment screws 35 allows the installer to visually position the bracket frame member 10 as desired so as to effect proper adjustment thereof. The frame member 10 is positioned within the opening such that the thick portions 18 of the wings 12 are flush with the inner surface of the wall covering 15 and the frame member 10 extends through the opening in the wall covering 15 and is generally flush with the wall covering 15.

Various means, tapes, staples, etc., may be utilized to maintain such a positioning of the bracket during the installation process. If used, the optional bendable metal tabs 51 are bent over the wall covering 15 so as to maintain positioning of the bracket during the installation process. Next, the speaker or speaker assembly is attached to the bracket by passing screws or bolts through the speaker or speaker assembly and into the threaded apertures 24 formed within the bracket frame member 10. Tightening of such fasteners draws the thick portions 18 of the wing members 12 tightly against the inner surface of the wall covering 15 as the speaker assembly, i.e., typically the bezel 13 thereof, is similarly drawn tightly against the outer surface of the wall covering 15. Thus, clamping the wall covering 15 between the thick portions 18 of the wing members 12 and the speaker assembly results in secure attachment of the speaker assembly and bracket to the wall.

Figure 8:
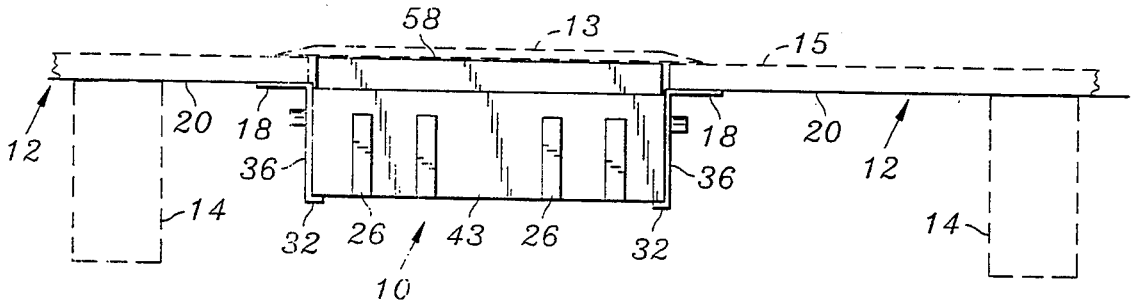
FIG. 8 is a top view illustrating use of the depth adjustable bracket in a new construction installation.

Referring now to FIG. 8, when using the depth adjustable thin winged bracket of the present invention in new construction installations the thin portions 20 of the wings 12 are attached via staples, nails, screws, etc., to adjacent studs 14 of the wall frame. The positioning of the wing members relative to the bracket frame member 10 may be adjusted prior to such attachment to compensate for the thickness of the wall covering 15. Alternatively, such depth positioning of the bracket frame member 10 may be adjusted after attachment of the wing members 12 to the studs 14 via adjustment screws 35. As in retrofit installations, the positioning of the wing members 12 relative to the bracket frame member 10 is adjusted such that the front edge 58 of the bracket frame member 10 will be approximately flush to the outer surface of the wall covering 15 when installation is complete.

Prior to applying the wall covering 15 to the wall, an opening corresponding generally in size and shape to the frame member 10 is formed therein. To avoid the need for later patching of the wall covering 15, care should be taken that the opening not extend beyond the bezel of the speaker assembly.

The wall covering 15 is applied to the wall studs 14 of the wall frame such that the bracket frame member 10 is received within the opening of the wall covering 15. Next, the speaker assembly is attached to the bracket frame member 10 by passing fasteners, i.e., screws or bolts, therethrough and into the threaded apertures 24 of the wall frame 10. Tightening of the fasteners causes the wall covering 15 to be clamped intermediate the thick portions 18 of the wings 20 and the speaker assembly. Thus, the thin portions 20 of the wing member 12 facilitate attachment of the bracket to the wall frame at a desired location and hold the bracket in place until the wall covering 15 is clamped between the thick portions 18 of the wing members 12 and the speaker assembly, i.e., the bezel 13 thereof.

Thus, it is understood that the exemplary depth adjustable thin winged bracket for wall mount speakers of the present invention described herein and in the drawings represents only a presently preferred embodiment of the invention. Various modifications and additions may be made to such embodiment without departing from the spirit and scope of the invention. For example, the wings need not be generally rectangular in shape as illustrated and described, but rather may be of any suitable shape. Also, those skilled in the art will recognize that various means are suitable for providing sliding adjustability of the wing members 12 relative to the frame member 10. Thus, these and other modifications and additions may be obvious to those skilled in the art and may be implemented to adapt the present invention for use in a variety of different applications.

What is claimed is:

1. A bracket for use in both new construction and retrofit in-wall mounting of speakers, said bracket comprising:

(a) a bracket frame member configured to receive at least one speaker;

(b) a plurality of wing members attached to said bracket frame member, each wing member comprising:

i) a first portion disposed proximate said bracket frame member; and ii) a second portion extending from said first portion;

iii ) wherein said second portion is capturable intermediate a wall frame member and wall covering in new construction installations and wherein said second portion is severable from said first portion to facilitate use of the bracket in retrofit installations.

2. The bracket as recited in claim 1 wherein said second portion is thinner than said first portion.

3. The bracket as recited in claim 1 further comprising at least one position adjuster for adjusting the position of said wing members relative to said bracket frame member after said bracket is installed in a wall.

4. The bracket as recited in claim 1 wherein:

(a) said first portion is greater than approximately 0.040-inch thick; and (b) said second portion is less than approximately 0.040-inch thick.

5. The bracket as recited in claim 1 wherein:

(a) said first portion is approximately 0.10-inch thick; and (b) said second portion is approximately 0.020-inch thick.

6. The bracket as recited in claim 1 wherein said first and second portions of said wing members are generally rectangular in configuration.

7. The bracket as recited in claim 1 wherein said bracket frame member is generally rectangular in configuration.

8. The bracket as recited in claim 1 wherein each wing member is generally rectangular in configuration.

9. A bracket for the in-wall mounting of speakers, said bracket comprising:

(a) a bracket frame member configured to receive at least one speaker; and (b) a plurality of wing members attached to said bracket frame member, each wing member comprising flattenable corrugations formed therein to increase the strength thereof.

10. The bracket as recited in claim 9 further comprising at least one position adjuster for adjusting the position of said wing members relative to said bracket frame member after said bracket frame member is installed in a wall.

11. The bracket as recited in claim 9 wherein said position adjuster adjusts the depth at which said bracket frame member is disposed within the wall.

12. The bracket as recited in claim 9 wherein said corrugations are configured to flatten when said wing members are disposed intermediate a wall stud and a wall covering.

13. The bracket as recited in claim 9 wherein said corrugations are formed progressively deeper the farther they are away from said bracket frame member.

14. A bracket for the in-wall mounting of speakers, said bracket comprising: (a) a bracket frame member configured to receive at least one speaker; (b) a plurality of wing members attached to said bracket frame member; and (c) at least one position adjuster for adjusting the position of said wing members relative to said bracket frame member after said bracket frame member is installed in a wall, said position adjuster comprising:

i) first detents formed upon said bracket frame member; and ii) complementary second detents formed upon said wing members for releasably attaching said wing members to said bracket frame member to provide a desired adjustment thereof.

* * * * *